US008675030B2

(12) United States Patent
Doyen et al.

(10) Patent No.: US 8,675,030 B2
(45) **Date of Patent: *Mar. 18, 2014**

(54) METHOD FOR DISPLAYING A VIDEO IMAGE ON A DIGITAL DISPLAY DEVICE

(75) Inventors: Didier Doyen, La Bouexiere (FR); Thierry Borel, Chantepie (FR); Jonathan Kervec, Geveze (FR)

(73) Assignee: Thomson Licensing S.A., Boulogne Billancourt (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/505,925

(22) PCT Filed: Mar. 7, 2003

(86) PCT No.: PCT/FR03/00734

§ 371 (c)(1),
(2), (4) Date: Aug. 27, 2004

(87) PCT Pub. No.: WO03/075251

PCT Pub. Date: Sep. 12, 2003

(65) Prior Publication Data

US 2005/0105008 A1 May 19, 2005

(30) Foreign Application Priority Data

Mar. 7, 2002 (FR) ..... 02 03141

(51) Int. Cl.
*G09G 5/10* (2006.01)

(52) U.S. Cl.
USPC ..... 345/691; 345/84; 345/108

(58) Field of Classification Search
USPC ..... 345/690, 108–111, 691–692, 84
See application file for complete search history.

(56) References Cited

U.S. PATENT DOCUMENTS

| | | | | |
|---|---|---|---|---|
| 5,619,228 | A | 4/1997 | Doherty | |
| 5,986,640 | A * | 11/1999 | Baldwin et al. | 345/596 |
| 6,275,271 | B1 | 8/2001 | Hitomi et al. | |
| 6,388,661 | B1 * | 5/2002 | Richards | 345/204 |
| 6,392,656 | B1 | 5/2002 | Someya et al. | |
| 6,639,605 | B2 * | 10/2003 | Van Dalfsen et al. | 345/690 |
| 6,781,742 | B2 * | 8/2004 | Yamazaki et al. | 359/290 |
| 7,227,561 | B2 * | 6/2007 | Doyen et al. | 345/691 |
| 2005/0052388 | A1 * | 3/2005 | Handschy et al. | 345/89 |

FOREIGN PATENT DOCUMENTS

| | | |
|---|---|---|
| EP | 0875881 | 11/1998 |
| EP | 1052614 | 11/2000 |
| EP | 1180714 | 2/2002 |
| JP | 11-327492 | 11/1999 |
| WO | WO 03023751 A1 * | 3/2003 |

OTHER PUBLICATIONS

Search Report Dated Oct. 9, 2003.

* cited by examiner

*Primary Examiner* — Michael Pervan
(74) *Attorney, Agent, or Firm* — Vincent E. Duffy; Joel M. Fogelson

(57) ABSTRACT

The present invention relates to a method for displaying a video image on a digital display device during a video frame comprising at least two distinct time segments for displaying a grey level. The cells of the device are able to take selectively an on state or an off state. The cells are able moreover to change state several times during a video frame. According to the invention, the cells change state at most once during each time segment of the video frame. The invention makes it possible to attenuate or suppress disturbances related to the temporal integration and to the sequential displaying of the R, G, B components of the video image.

9 Claims, 5 Drawing Sheets

METHOD FOR DISPLAYING A VIDEO IMAGE ON A DIGITAL DISPLAY DEVICE

This application claims the benefit, under 35 U.S.C. §365 of International Application PCT/FR03/00734,filed Mar. 7, 2003,which was published in accordance with PCT Article 21(2)on Sep. 12, 2003 in French and which claims the benefit of French patent application No. 0203141, filed Mar. 7, 2002.

BACKGROUND OF THE INVENTION (1) Field of the Invention

The present invention relates to a method for displaying a video image on a digital display device. The invention applies most particularly to apparatus for projection and for back-projection, of television sets or monitors.

(2) Description of Related Art

Among display devices, digital display devices are devices comprising one or more cells which can take a finite number of illumination values. Currently, this finite number of values is equal to two and corresponds to an on state and an off state of the cell. To obtain a larger number of grey levels, it is known to temporally modulate the state of the cells over the video frame so that the human eye, by integrating the pulses of light resulting from these changes of state, can detect intermediate grey levels.

Among the known digital display devices, there are those comprising a digital micromirror matrix or DMD matrix (DMD standing for Digital Micromirror Device). A DMD matrix is a component, conventionally used for video-projection, which is formed of a chip on which are mounted several thousand microscopic mirrors or micromirrors which, controlled on the basis of digital data, serve to project an image onto a screen, by pivoting in such a way as to reflect or to block the light originating from an external source. The technology based on the use of such micromirror matrices and consisting in a digital methoding of light is known as "Digital Light Methoding" or DLP.

In DLP technology, one micromirror per image pixel to be displayed is provided. The micromirror exhibits two operating positions, namely an active position and a passive position, on either side of a quiescent position. In the active position, the micromirror is tilted by a few degrees (around 10 degrees) with respect to its quiescent position so that the light originating from the external source is projected onto the screen through a projection lens. In the passive position, the micromirror is tilted by a few degrees in the opposite direction so that the light originating from the external source is directed towards a light absorber. The periods of illumination of a pixel therefore correspond to the periods during which the associated micromirror is in the active position.

Thus, if the light supplied to the micromirror matrix is white light, the pixels corresponding to the micromirrors in the active position are white and those corresponding to the micromirrors in the passive position are black. The intermediate grey levels are obtained by temporal modulation of the light projected onto the screen corresponding to a PWM modulation (PWM standing for Pulse Width Modulation). Specifically, each micromirror is capable of changing position several thousand times a second. The human eye does not detect these changes of position, nor the light pulses which result therefrom, but integrates the pulses between them and therefore perceives the average light level. The grey level detected by the human eye is therefore directly proportional to the time for which the micromirror is in the active position in the course of a video frame.

To obtain 256 grey levels, the video frame is for example divided into eight consecutive sub-periods of different weights. These sub-periods are commonly called subfields. During each subfield, the micromirrors are either in an active position, or in a passive position. The weight of each subfield is proportional to its duration. FIG. 1 shows an exemplary distribution of the subfields within a video frame. The duration of the video frame is 16.6 or 20 ms depending on the country. The video frame given as an example comprises eight subfields of respective weights 1, 2, 4, 8, 16, 32, 64 and 128. The periods of illumination of a pixel correspond to the subfields during which the associated micromirror is in an active position. The human eye temporally integrates the pixel illumination periods and detects a grey level proportional to the overall duration of the illumination periods in the course of the video frame.

A few problems related to the temporal integration of the illumination periods exist. A problem of false contours appears in particular when an object moves between two consecutive images. This problem is manifested by the appearance of darker or lighter bands on grey level transitions that are normally hardly perceptible. For colour apparatus, these bands may be coloured.

This problem of false contours is illustrated by FIG. 2 representing the subfields for two consecutive images, I and I+1, comprising a transition between a grey level 127 and a grey level 128. This transition moves by 4 pixels between image I and image I+1. In this figure, the ordinate axis represents the time axis and the abscissa axis represents the pixels of the various images. The integration done by the eye amounts to integrating temporally along the oblique lines represented in the figure since the eye tends to follow the object in motion. It therefore integrates information originating from different pixels. The result of the integration is evident through the appearance of a grey level equal to zero at the moment of the transition between the grey levels 127 and 128. This crossing through the zero grey level gives rise to the appearance of a dark band at the level of the transition. In the reverse case, if the transition crosses from the level 128 to the level 127, a level 255 corresponding to a light band appears at the moment of the transition.

A known solution to this problem consists in "breaking" the subfields of high weight so as to decrease the integration error. FIG. 3 represents the same transition as FIG. 2 but with seven subfields of weight 32 instead of the three subfields of weights 32, 64 and 128. The integration error is then at the maximum of a grey level value equal to 32.

It is also possible to distribute the grey levels differently but an integration error still remains.

Furthermore, as in all video appliances, the displaying of a colour image requires the displaying of three images (red, green and blue). In projectors with single DMD matrix, these three images are displayed sequentially. Consequently, such projectors comprise a rotating wheel comprising red, green and blue filters through which the white light originating from the source of the projector is filtered before being transmitted to the DMD matrix. The DMD matrix is thus supplied sequentially with red, green and blue light during the video frame. The rotating wheel generally comprises six filters (2 red, 2 green, 2 blue) and rotates at a frequency of 150 or 180 revs/second, i.e. 3 revolutions per video frame. The digital data of the R, G and B components of the video image are supplied to the DMD matrix in a manner which is synchronized with the red, green and blue light so that the R, G and B components of the image are displayed with the appropriate light. The video frame can therefore be chopped into 18 time segments, 6 for each colour, as illustrated in FIG. 4. In the case of a video frame of 20 ms, the duration of each segment is around 1.1 ms. The subfields shown in FIG. 1 are distributed, for each colour, over the 6 time segments of each colour. The subfield of high weight is for example chopped into six elementary periods each tied to a different time segment whereas the subfield of low weight is present only in one of the 6 segments.

This type of projector exhibits a colour separation defect, also known by the name "colour break-up", on account of the sequential displaying of the colours. This defect is visible whenever the eye follows a moving object travelling rapidly in the image. The light areas of the image exhibiting a strong contrast then seem to break up momentarily into red, green and blue bands along the direction of motion. Given that the R, G, B components of the image are displayed sequentially and that the eye shifts while following the motion, the colours are therefore reproduced on different locations of the retina of the eye. This therefore prevents the brain from integrating them together into a colour image. Likewise, sudden movements of the eye over a still image may also interrupt the integration of the pulses of light in the brain and disturb the perception of the actual grey level.

SUMMARY OF THE INVENTION

The aim of the invention is to propose a method for displaying a video image on a digital display device making it possible to reduce, or even eliminate, these problems of false contour effects.

Another aim of the invention is to propose a display method making it possible to limit these colour separation problems when the colours are displayed sequentially in the digital display device.

Also, according to the invention, there is provision to apply a particular coding to the digital data supplied to the DMD matrix to attenuate or suppress all the disturbances related to the temporal integration and to the sequential displaying of the R, G, B components of the video image.

The invention is a method for displaying a video image on a digital display device during a video frame comprising at least two distinct time segments for displaying a grey level, said digital display device comprising a plurality of cells, each cell being able to take selectively an on state or an off state, each cell being able moreover to change state several times during a video frame. Each cell changes state at most once during each time segment of the video frame.

When displaying of a video image is carried out by the sequential displaying of three images of red, green and blue colour, respectively in the digital display device, the video frame comprises at least two non-consecutive time segments for each colour.

Each time segment preferably comprises a plurality of consecutive subfields, of different durations and during each of which each cell is either in an on state, or in an off state.

This display makes it possible in particular not to introduce any "time gaps" into the segment, which time gaps are generally generators of disturbances during the temporal integration.

Preferably, for each colour, the duration of the subfields of said at least two time segments is determined in such a way that the duration of the on state of the cells increases according to an inverse gamma correction curve.

The invention is also a device for the digital displaying of a video image during a video frame comprising at least two distinct time segments for displaying a grey level, said digital display device comprising a plurality of cells, each cell being able to take selectively an on state or an off state, each cell being able moreover to change state several times during a video frame. The device comprises means for changing the state of the cells at most once during each time segment of the video frame.

According to one embodiment, the digital display device comprises a digital matrix of micromirrors. Each cell of the digital display device is associated with a micromirror. A cell of the device is in an on state when the associated micromirror is in an active position in which it contributes to the projection of light onto a screen of the device and is in an off state when the associated micromirror is in a passive position in which it prevents said projection of light onto said screen.

BRIEF DESCRIPTION OF THE DRAWINGS

Other characteristics and advantages of the invention will become apparent on reading the detailed description which follows and which is given with reference to the appended drawings, in which.

DETAILED DESCRIPTION OF THE INVENTION

Figure 1:
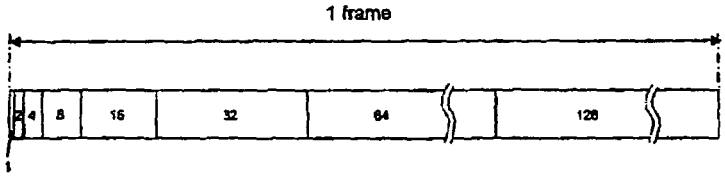
FIG.1 (PRIOR ART)
FIG. 1 represents an exemplary distribution of the subfields in a video frame for a pulse duration modulation appliance.
Figure 4:
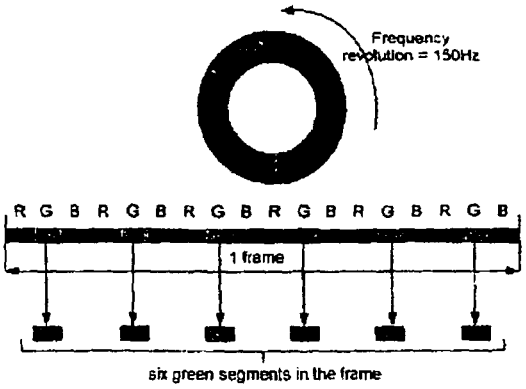
FIG.4 (PRIOR ART)
FIG. 4 represents a conventional video frame for the displaying of a colour image in appliances having a single digital micromirror matrix.
Figure 2:
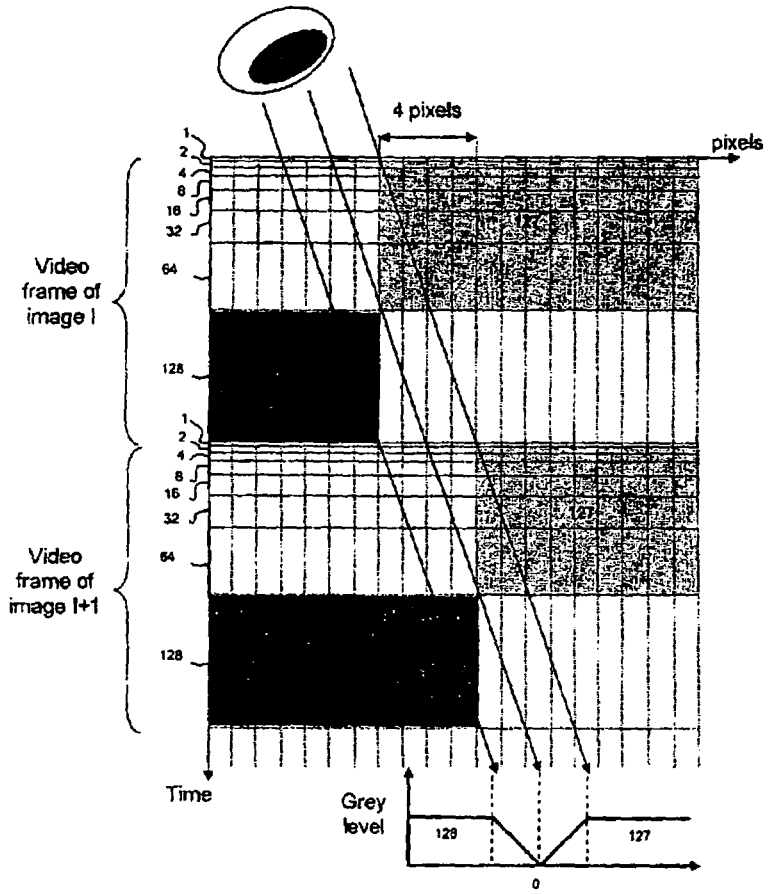
FIG.2 (PRIOR ART)
FIG. 2 illustrates the phenomenon of false contour effects that is present when a transition moves between two consecutive images.
Figure 3:
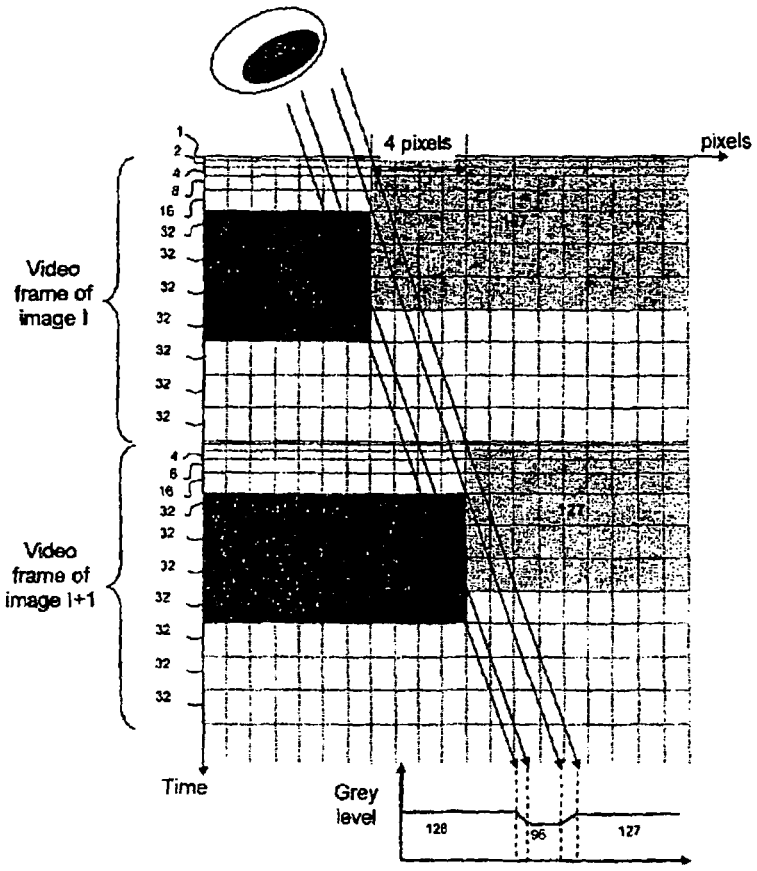
FIG.3 (PRIOR ART)
FIG. 3 illustrates a known solution for restricting the phenomenon of false contour effects.

According to the invention, there is provision to use a so-called incremental coding of the grey levels on each of the segments of the video frame.

This incremental coding is designed so as not to create disturbances related to the temporal integration by the human eye during the displaying of a video image. According to this coding which is applied to the digital data supplied to the DMD matrix, the micromirrors of the DMD matrix change position at most once during each segment of the videoframe. Thus, if a micromirror is in an active position at the start of a segment and switches into a passive position in the course of this segment, it remains in this position until the end of the segment.

More generally, this amounts to saying that, according to the invention, the cells of the digital display device change state (on or off) at most once during each segment of the video frame.

Each segment of the video frame comprises a plurality of subfields of different weights. As indicated in the preamble, the micromirrors do not change position during the subfields. Also, if a micromirror of the DMD matrix is in an active position at the start of the segment and switches to a passive position at the start of a subfield of this segment, it remains in this position during the remaining subfields of the segment.

This coding allows the display of only a restricted number of possible grey levels. For a segment comprising N subfields, it allows the display of a maximum of N+1 grey level values.

However, techniques of error broadcasting or of noising, commonly referred to as "dithering", which are well known to the person skilled in the art, make it possible to compensate for this small number of grey levels. The principle of the "dithering" technique consists in decomposing the sought-after grey level into a combination of displayable grey levels which, through temporal integration (these grey levels are displayed on several successive images) or through spatial integration (these grey levels are displayed in an area of the image encompassing the relevant pixel), restore on the screen a grey level close to the sought-after grey level.

The main advantage of this coding is that it does not create any "time gaps" in the segment, said gaps being generators of disturbances during the temporal integration. A time gap designates an "on" subfield (subfield during which the pixel exhibits a non zero grey level) between two off subfields (subfields during which the pixel exhibits a zero grey level) or vice versa.

To illustrate the method of the invention, we shall consider a video frame having a duration of 20 ms (frequency=50 Hz) and comprising 6 time segments per colour, i.e. 18 time segments. Each time segment exhibits a duration of around 1.1 ms. Given that the addressing of the totality of the micromirrors of the DMD matrix takes around 95 μs in current DLP technology, it is possible to address the DMD matrix at least 60 times per frame for each colour, i.e. 10 times per segment. We shall therefore use an incremental coding comprising 61 grey levels (the zero grey level+60 non zero grey levels).

Table 1, represented below, associates, with each of the 61 values of grey level, a value of illumination time during a video frame. The first column of Table 1 corresponds to the indices of the grey levels, the second corresponds to the illumination time (in microseconds) necessary to obtain these grey levels during a video frame and the third represents the difference in illumination time (in microseconds) between the grey level considered and the preceding one.

TABLE 1

| Index | Time | Difference |
|---|---|---|
| NG0 | 0.00 | 0 |
| NG1 | 12.00 | 12.00 |
| NG2 | 16.99 | 4.99 |
| NG3 | 25.31 | 8.32 |
| NG4 | 36.96 | 11.65 |
| NG5 | 51.93 | 14.97 |
| NG6 | 70.23 | 18.30 |
| NG7 | 91.86 | 21.63 |
| NG8 | 116.82 | 24.96 |
| NG9 | 145.10 | 28.28 |
| NG10 | 176.72 | 31.61 |
| NG11 | 211.66 | 34.94 |
| NG12 | 249.92 | 38.27 |
| NG13 | 291.52 | 41.59 |
| NG14 | 336.44 | 44.92 |
| NG15 | 384.69 | 48.25 |
| NG16 | 436.27 | 51.58 |

TABLE 1-continued

| | | |
|---|---|---|
| NG17 | 491.17 | 54.91 |
| NG18 | 549.41 | 58.23 |
| NG19 | 610.97 | 61.56 |
| NG20 | 675.85 | 64.89 |
| NG21 | 744.07 | 68.22 |
| NG22 | 815.61 | 71.54 |
| NG23 | 890.48 | 74.87 |
| NG24 | 968.68 | 78.20 |
| NG25 | 1050.21 | 81.53 |
| NG26 | 1135.06 | 84.85 |
| NG27 | 1223.24 | 88.18 |
| NG28 | 1314.75 | 91.51 |
| NG29 | 1409.59 | 94.84 |
| NG30 | 1507.75 | 98.16 |
| NG31 | 1609.24 | 101.49 |
| NG32 | 1714.06 | 104.82 |
| NG33 | 1822.21 | 108.15 |
| NG34 | 1933.68 | 111.47 |
| NG35 | 2048.49 | 114.80 |
| NG36 | 2166.62 | 118.13 |
| NG37 | 2288.07 | 121.46 |
| NG38 | 2412.86 | 124.78 |
| NG39 | 2540.97 | 128.11 |
| NG40 | 2672.41 | 131.44 |
| NG41 | 2807.18 | 134.77 |
| NG42 | 2945.27 | 138.10 |
| NG43 | 3086.69 | 141.42 |
| NG44 | 3231.44 | 144.75 |
| NG45 | 3379.52 | 148.08 |
| NG46 | 3530.93 | 151.41 |
| NG47 | 3685.66 | 154.73 |
| NG48 | 3843.72 | 158.06 |
| NG49 | 4005.11 | 161.39 |
| NG50 | 4169.82 | 164.72 |
| NG51 | 4337.87 | 168.04 |
| NG52 | 4509.24 | 171.37 |
| NG53 | 4683.94 | 174.70 |
| NG54 | 4861.96 | 178.03 |
| NG55 | 5043.32 | 181.35 |
| NG56 | 5228.00 | 184.68 |
| NG57 | 5416.01 | 188.01 |
| NG58 | 5607.34 | 191.34 |
| NG59 | 5802.01 | 194.66 |
| NG60 | 6000.00 | 197.99 |

In Table 1, the values of illumination time have been advantageously chosen to follow an inverse gamma correction curve. In the present document, the inverse gamma correction corresponds to the suppression of the gamma correction which exists in certain image sources that are intended to be viewed on tubes. Specifically, in contradistinction to cathode ray tubes, the ratio between the grey levels on input (original image) and the grey levels on output (on the screen) in DMD matrices is linear. Now, given that a gamma correction is carried out on the source image at the camera level, an inverse gamma correction must be applied to the image originating from the camera to obtain a correct image on the screen. According to the invention, this inverse gamma correction is therefore performed in the course of the coding of the digital data supplied to the DMD matrix.

The inverse gamma correction curve employed in Table 1 is given by the following formula:

$$\begin{cases} a\left(\frac{x}{60}\right)^2 + b = y \\ \text{where } a \text{ and } b \text{ are constants} \\ x \text{ is a grey level index lying between 0 and 60} \\ y \text{ is a time period} \end{cases}$$

Figure 5:
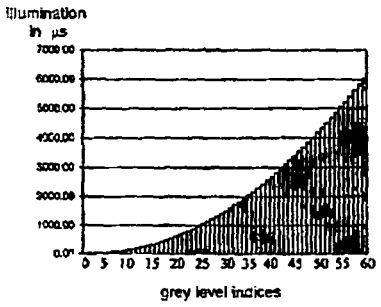
FIG. 5 represents a graph representing the illumination time for each grey level in an exemplary embodiment of the method of the invention.

For the sake of simplification, in this table we have considered that the overall duration of the 6 time segments of one and the same colour is 6 ms instead of 6.66 ms. This table is also represented in the form of a graph in FIG. 5. This graph shows immediately that the illumination times defined in this table actually follow an inverse gamma correction curve.

The illumination time of each grey level is distributed, for each colour, over the 6 time segments. According to the invention, this illumination time is reproduced by at most one pulse of light of variable duration in each time segment since the micromirrors change position at most once in the course of each time segment.

The difference in illumination time between two successive grey levels is associated with one of the six time segments of the video frame. Thus, for a given grey level, the additional illumination time corresponding to the difference in illumination time between this grey level and the immediately lower grey level, is effected on a single segment of the video frame. Table 2 illustrates the position of the additional illumination times of each grey level. It indicates more exactly, for each grey level labelled by its index, the segment in which the additional illumination time is carried out.

TABLE 2

| Segment1 | Segment2 | Segment3 | Segment4 | Segment5 | Segment6 |
|---|---|---|---|---|---|
| NG0 | NG0 | NG0 | NG0 | NG0 | NG0 |
| NG1 | **NG2** | **NG3** | **NG4** | NG5 | NG6 |
| NG7 | NG8 | NG9 | NG10 | NG11 | NG12 |
| NG13 | NG14 | NG15 | NG16 | NG17 | NG18 |
| NG19 | NG20 | NG21 | NG22 | NG23 | NG24 |
| NG25 | NG26 | NG27 | NG28 | NG29 | NG30 |
| NG31 | NG32 | NG33 | NG34 | NG35 | NG36 |
| NG37 | NG38 | NG39 | NG40 | NG41 | NG42 |
| NG43 | NG44 | NG45 | NG46 | NG47 | NG48 |
| NG49 | NG50 | NG51 | NG52 | NG53 | NG54 |
| NG55 | NG56 | NG57 | NG58 | NG59 | NG60 |

Table 2 shows, for example, that the grey level NG28 is obtained by increasing, with respect to the grey level NG27, the illumination time of the fourth segment of the video frame.

The additional illumination time of each grey level with respect to the immediately lower grey level is indicated in Table 3 which follows.

TABLE 3

| Segment1 | Segment2 | Segment3 | Segment4 | Segment5 | Segment6 |
|---|---|---|---|---|---|
| 0.00 | 0.00 | 0.00 | 0.00 | 0.00 | 0.00 |
| 12.00 | **4.99** | **8.32** | **11.65** | 14.97 | 18.30 |
| 21.63 | 24.96 | 28.28 | 31.61 | 34.94 | 38.27 |
| 41.59 | 44.92 | 48.25 | 51.58 | 54.91 | 58.23 |
| 61.56 | 64.89 | 68.22 | 71.54 | 74.87 | 78.20 |
| 81.53 | 84.85 | 88.18 | 91.51 | 94.84 | 98.16 |
| 101.49 | 104.82 | 08.15 | 111.47 | 114.80 | 118.13 |
| 121.46 | 124.78 | 128.11 | 131.44 | 134.77 | 138.10 |
| 141.42 | 144.75 | 148.08 | 151.41 | 154.73 | 158.06 |
| 161.39 | 164.72 | 168.04 | 171.37 | 174.70 | 178.03 |
| 181.35 | 184.68 | 188.01 | 191.34 | 194.66 | 197.99 |

Returning to the above example, Table 3 indicates that the grey level NG28 is obtained by increasing the illumination time of the fourth segment by 91.51 μs with respect to the grey level NG27.

It should be noted however that the additional illumination time for the grey levels NG2, NG3 and NG4 is less than 12 μs (minimum switching time of a micromirror in current DLP technology). These grey levels (shown in bold in Tables 2 and 3) cannot therefore be coded according to an incremental code in so far as it is not possible to obtain an illumination time of less than 12 μs during a time segment.

Consequently, the grey levels NG2, NG3 and NG4 are coded according to a conventional code. Their illumination time (greater than 12 μs) is therefore executed over a single segment as for the grey level NG1. The illumination times of the levels NG1, NG2, NG3 and NG4 indicated in bold characters in Table 4 below are therefore additional illumination times defined with respect to the grey level NG0.

TABLE 4

| Segment1 | Segment2 | Segment3 | Segment4 | Segment5 | Segment6 |
|---|---|---|---|---|---|
| 0.00 | 0.00 | 0.00 | 0.00 | 0.00 | 0.00 |
| **12.00** | **16.99** | **25.31** | **36.96** | 14.97 | 18.30 |
| 21.63 | 24.96 | 28.28 | 31.61 | 34.94 | 38.27 |
| 41.59 | 44.92 | 48.25 | 51.58 | 54.91 | 58.23 |
| 61.56 | 64.89 | 68.22 | 71.54 | 74.87 | 78.20 |
| 81.53 | 84.85 | 88.18 | 91.51 | 94.84 | 98.16 |
| 101.49 | 104.82 | 08.15 | 111.47 | 114.80 | 118.13 |
| 121.46 | 124.78 | 128.11 | 131.44 | 134.77 | 138.10 |
| 141.42 | 144.75 | 148.08 | 151.41 | 154.73 | 158.06 |
| 161.39 | 164.72 | 168.04 | 171.37 | 174.70 | 178.03 |
| 181.35 | 184.68 | 188.01 | 191.34 | 194.66 | 197.99 |

According to the invention, the grey levels are therefore coded as shown in Table 5. Table 5 gives the illumination times and their distribution over the 6 time segments for the first 15 grey levels and the last 2.

TABLE 5

| | Seg1 | + | Seg2 | + | Seg3 | + | Seg4 | + | Seg5 | + | Seg6 |
|---|---|---|---|---|---|---|---|---|---|---|---|
| NG0 = 0 = | **0** | + | **0** | + | **0** | + | **0** | + | **0** | + | **0** |
| NG1 = 12 = | **12** | + | **0** | + | **0** | + | **0** | + | **0** | + | **0** |

TABLE 5-continued

| | Seg1 | + | Seg2 | + | Seg3 | + | Seg4 | + | Seg5 | + | Seg6 |
|---|---|---|---|---|---|---|---|---|---|---|---|
| NG2 = 16.99 = | **0** | + | **16.99** | + | **0** | + | **0** | + | **0** | + | **0** |
| NG3 = 25.31 = | **0** | + | **0** | + | **25.31** | + | **0** | + | **0** | + | **0** |
| NG4 = 36.96 = | **0** | + | **0** | + | **0** | + | **36.96** | + | **0** | + | **0** |
| NG5 = 51.93 = | 0 | + | 0 | + | 0 | + | 36.96 | + | 14.97 | + | 0 |
| NG6 = 70.23 = | 0 | + | 0 | + | 0 | + | 36.96 | + | 14.97 | + | 18.30 |
| NG7 = 91.86 = | 21.63 | + | 0 | + | 0 | + | 36.96 | + | 14.97 | + | 18.30 |
| NG8 = 116.82 = | 21.63 | + | 24.96 | + | 0 | + | 36.96 | + | 14.97 | + | 18.30 |
| NG9 = 145.1 = | 21.63 | + | 24.96 | + | 28.28 | + | 68.57 | + | 14.97 | + | 18.30 |
| NG10 = 176.72 = | 21.63 | + | 24.96 | + | 28.28 | + | 68.57 | + | 49.91 | + | 18.30 |
| NG11 = 211.66 = | 21.63 | + | 24.96 | + | 28.28 | + | 68.57 | + | 49.91 | + | 56.57 |
| NG12 = 249.92 = | 63.22 | + | 24.96 | + | 28.28 | + | 68.57 | + | 49.91 | + | 56.57 |
| NG13 = 291.52 = | 63.22 | + | 69.88 | + | 28.28 | + | 68.57 | + | 49.91 | + | 56.57 |
| NG14 = 336.44 = | 63.22 | + | 69.88 | + | 76.53 | + | 68.57 | + | 49.91 | + | 56.57 |
| . | | | | | | . | | | | | |
| . | | | | | | . | | | | | |
| . | | | | | | . | | | | | |
| NG59 = 5802.01 = | 913.42 | + | 943.37 | + | 973.32 | + | 1040.23 | + | 1048.19 | + | 883.48 |
| NG60 = 6000 = | 913.42 | + | 943.37 | + | 973.32 | + | 1040.23 | + | 1048.19 | + | 1081.47 |

Figure 6:
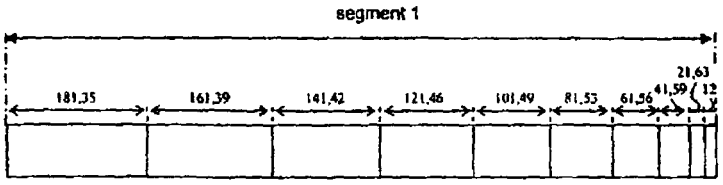
FIG. 6 represents the distribution of the subfields in the first segment of each colour for said exemplary embodiment of the method of the invention.

Referring to Table 4, it is possible to determine the duration of the 10 subfields (10 addressings per time segment) of the 6 time segments of each colour. For example, the first segment comprises 10 subfields having respective durations 181.35 μs, 161.39s, 141.42 μs, 121.46 μs, 101.49 μs, 81.53 μs, 62.56 μs, 41.59 μs, 21.63 μs and 12 μs. The distribution of the subfields in the first time segment is shown in FIG. 6.

The subfields of duration 12 μs (segment 1) 16.99 μs (segment 2) and 25.31 μs (segment 3) are never "on" at the same time as the other subfields and serve only for the displaying of the grey levels NG1, NG2 and NG3.

For all the grey levels other than the levels NG1, NG2 and NG3, the micromirror concerned switches back into a quiescent position at the start of these three subfields. Thus, for all the grey levels, the micromirror switches from a passive position to an active position (or vice versa) at most once in the course of each time segment of the video frame.

Moreover, so as not to accentuate the problem of colour separation (or colour break-up), the illumination times are uniformly distributed over the 6 time segments in particular for the highest grey levels (cf Table 5).

This method also makes it possible to obtain a high resolution for the low grey levels. Specifically, the spacing between levels NG1 and NG2 being 4.99 μs, a resolution of 10 bits (6000/4.99) is obtained. By decreasing this spacing, it is possible to further increase this resolution (11 bits for a spacing of 3 μs). In the codings currently employed, this resolution is at best 9 bits (spacing of 12 μs imposed by the technology).

Figure 7:
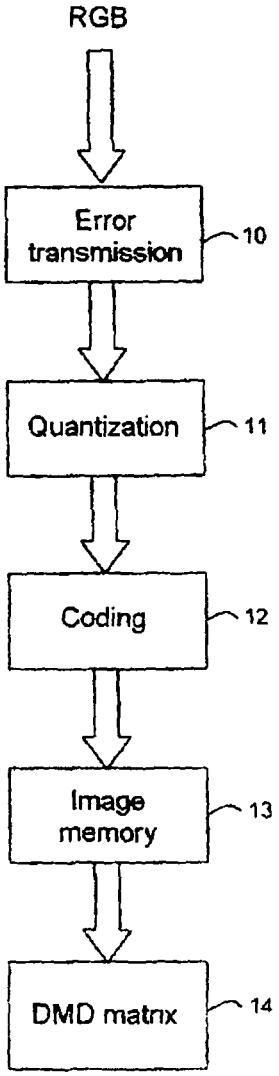
FIG. 7 represents an exemplary device implementing the method of the invention.

Very many structures are possible for implementing the method of the invention. A device implementing the method of the invention is represented in FIG. 7. A stream of R, G, B video signals is received by an error transmission circuit 10 and a quantization circuit 11 for limiting the number of grey levels to be displayed. These two circuits are intended to implement the "dithering" technique. The algorithm implemented in the error transmission circuit 10 is for example that of Floyd and Steinberg. At the end of the quantization, the grey levels are coded on 6 bits (61 possible grey levels). Next, the signals are methoded by a circuit 12 which is intended to implement more particularly the method of the invention. The circuit 12 may be defined as a look up table or LUT receiving as input grey levels coded on 6 bits and delivering as output grey levels coded on 60 bits (10 bits for each segment), each of the distributed 60 bits referring to a binary plane and each binary plane corresponding to the display of a subfield. The grey levels coded on 60 bits on output from the circuit 12 comply with the invention in the sense that, when one of the 10 bits referring to a time segment changes value, the following bits of this segment retain this value. The grey levels coded on 60 bits are next stored in an image memory 13, each bit being stored in a memory area dedicated to a binary plane. These binary planes are next read by a DMD matrix 14. This scheme is given merely by way of illustration.

The invention has been described within the framework of a digital display device comprising a digital micromirror matrix. The invention is not limited to this type of device. The invention may be used with other means of display exhibiting characteristics in common with micromirrors such as for example digital displays of LCOS type.

The invention claimed is:

1. Method for displaying a video image on a digital display device during a video frame, wherein the displaying of a video image is carried out by the sequential displaying of three images of red, green and blue color, respectively, the video frame comprising at least two non-consecutive time segments for each color, said digital display device comprising a plurality of cells, each cell being able to take selectively an on state or an off state, each cell being able moreover to change state several times during a video frame, each time segment comprising a plurality of consecutive subperiods, called subfields, of different durations and during each subfield each cell is either in an on state or in an off state, where the method comprises the steps of:

coding grey levels of said video image where each cell changes state at most once during each time segment of the video frame for displaying said grey levels of the video image, and for all pairs of successive grey levels having a grey level above a threshold level, a difference in the duration of the on state of cells displaying two successive grey levels being associated with a single time segment of said at least two time segments, common part in the duration of the on state of said cells displaying said two successive grey levels being associated with same subfields for both successive grey levels, said threshold level corresponding to a grey level close to zero grey level, and displaying the grey levels of said video image.

2. Method according to claim 1, wherein, for one and the same color, said at least two time segments comprise different pluralities of subfields.

3. Method according to claim 1, wherein, for each color, the duration of the subfields of said at least two time segments is determined in such a way that the duration of the on state of the cells increases according to an inverse gamma correction curve.

4. Method according to claim 1, wherein the total duration of the subfields of each time segment is substantially equal to a predetermined value common to all said at least two time segments.

5. The method of claim 1, wherein each time segment is of an equal time duration.

6. The method of claim 1, wherein said threshold level corresponds to the grey level having a rank 3 in a grey level scale beginning with a grey level of rank 1 corresponding to the zero grey level.

7. Device for the digital displaying of grey levels of a video image during a video frame comprising means for sequentially displaying three images of red, green and blue color, respectively, wherein the video frame comprises at least two non-consecutive time segments for each color, said digital display device comprising a plurality of cells, each cell being able to take selectively an on state or an off state, each cell being able moreover to change state several times during the video frame, each time segment comprising a plurality of consecutive subperiods, called subfields, of different durations and during each subfield each cell is either in an on state or in an off state, and wherein said device comprises means for changing the state of the cells at most once during each time segment of the video frame for displaying a plurality of grey levels of said video image, and wherein for all pairs of successive grey levels having a grey level above a threshold level, difference in the duration of the on state of cells displaying two successive grey levels being associated with a single time segment of said at least two time segment, common part in the duration of the on state of said cells displaying said two successive grey levels being associated with same subfields for both successive grey levels, said threshold level corresponding to a grey level close to zero grey level.

8. Device according to claim 7, wherein it comprises a digital matrix of micromirrors, each cell of said device being associated with a micromirror, and in that the cells of said device are in an on state when the associated micromirrors are in an active position in which it contributes to the projection of light onto a screen of the device and are in an off state when the associated micromirrors are in a passive position in which it prevents said projection of light onto said screen.

9. The device according to claim 7, wherein each time segment is of an equal time duration.

* * * * *